US006193810B1

(12) United States Patent
Baum

(10) Patent No.: US 6,193,810 B1
(45) Date of Patent: Feb. 27, 2001

(54) WEB CLEANING METHOD

(75) Inventor: Scott A. Baum, Madison, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/451,606

(22) Filed: Nov. 30, 1999

Related U.S. Application Data

(62) Division of application No. 09/102,314, filed on Jun. 22, 1998, now Pat. No. 5,991,964.

(51) Int. Cl.[7] ..... B08B 5/02; B08B 5/04; B08B 7/04

(52) U.S. Cl. ..... 134/15; 134/21; 134/32; 134/36; 134/37; 15/309.1; 15/345

(58) Field of Search ..... 134/15, 21, 32, 134/36, 37; 15/309.1, 345, 306.1, 316.1

(56) References Cited

U.S. PATENT DOCUMENTS

| | | |
|---|---|---|
| 2,082,411 | 6/1937 | Merrill . |
| 2,515,223 | 7/1950 | Hollick . |
| 3,078,496 | 2/1963 | Doran et al. . |
| 3,420,710 | 1/1969 | Wollman . |
| 3,436,265 | 4/1969 | Gardner . |
| 3,495,932 | 2/1970 | Tuma . |
| 3,587,177 | 6/1971 | Overly et al. . |
| 3,629,952 | 12/1971 | Overly et al. . |
| 3,650,043 | 3/1972 | Overly et al. . |
| 3,704,482 | 12/1972 | Brannon . |
| 3,775,806 | 12/1973 | Olbrant et al. . |
| 4,166,001 | 8/1979 | Dunning et al. . |
| 4,198,061 | 4/1980 | Dunn . |
| 4,247,993 | 2/1981 | Lindström . |
| 4,454,621 | 6/1984 | Testone . |
| 4,594,748 | 6/1986 | Warfvinge . |
| 4,643,775 | 2/1987 | Reba et al. . |
| 4,905,500 | 3/1990 | Mason . |
| 4,932,140 | 6/1990 | Lepistö . |
| 5,129,998 | 7/1992 | Farrington, Jr. . |
| 5,304,254 | 4/1994 | Chino et al. . |
| 5,313,685 | 5/1994 | Kramer et al. . |
| 5,466,298 | 11/1995 | Pollock . |
| 5,490,300 | 2/1996 | Horn . |
| 5,494,554 | 2/1996 | Edwards et al. . |
| 5,577,294 | 11/1996 | Pollock . |
| 5,607,551 | 3/1997 | Farrington, Jr. et al. . |

*Primary Examiner*—Zeinab El-Arini
(74) *Attorney, Agent, or Firm*—Richard G. Lione; Brinks Hofer Gilson & Lione

(57) ABSTRACT

A method of cleaning tissue webs in a rewinder utilize the Coanda effect to produce an improved tissue product. The Coanda effect web cleaner utilizes the smooth flow of a thin layer of air to scrub off dust and lint embedded and entangled in the web surface while stabilizing the web in its travel. Two of these Coanda effect web cleaners arranged on opposite sides of a multiple-ply web in a rewinder are effective when operated according to the method of the invention to produce a rewound tissue with an unexpectedly low loose dust and lint count on its surfaces.

11 Claims, 3 Drawing Sheets

WEB CLEANING METHOD

RELATED APPLICATION

This application is a division of U.S. application Ser. No. 09/102,314, filed Jun. 22, 1998, and now U.S. Pat. No. 5,991,964.

FIELD OF THE INVENTION

This invention is generally in the field of paper manufacturing. It relates particularly to the manufacturing of tissue paper products such as facial tissue and the like.

BACKGROUND OF THE INVENTION

A common complaint among users of facial tissues is that loose dust particles and/or lint fall off the tissue before use. They accumulate on the tissue carton top and counter surfaces. They cling to eyeglass lens when the tissue is used to clean them. They are, of course, considered unacceptable by the consumer.

The terms "dust particles" and "lint" which are used here are relatively general when considered out of context. For purposes of discussing this invention, however, dust is considered to be discrete particles of 0.4 mm or less in length, while lint is considered to be composed of longer particles or fibers, most of which are tissue making fibers.

In the process by which facial tissue, for example, is manufactured, dust and lint are found in several contexts. The tissue web has a quantity of loose dust and lint embedded or entangled in its surfaces, much of it a by-product of the creping step. As the web travels through the tissue reeling and rewinding operations, a boundary layer of air attaches to each of the web surfaces and becomes contaminated with dust and lint entrained in the air flow. Finally, the larger environment in which the manufacturing operations take place also contains a certain amount of environmental dust and lint.

Regardless of where the dust and lint is found, producing tissue with a minimum amount of loose dust and lint remaining on the surface of the finished product has long been an aim of the manufacturing process. Most systems and methods for reducing dust and lint on tissue during production have relied primarily on area containment and removal which would meet OSHA air quality standards. Some systems have been employed which attempt to remove loose dust and lint directly from tissue during its manufacture, however. For example, it is known to simply direct air jets at the surfaces of a web in both the tissue forming machine and the rewinding machine in attempts to clean the web. Examples of web cleaners which employ such air jets are found in Doran et al. U.S. Pat. No. 3,078,496, Olbrant et al. U.S. Pat. No. 3,775,806 and Warfvinge U.S. Pat. No. 4,594,748.

It is also known to employ the Coanda effect to dry tissue webs and to remove dust and other particulate materials clinging to tissue webs in the tissue forming machine. The Lindstrom U.S. Pat. No. 4,247,993 and the Lepisto U.S. Pat. No. 4,932,140 describe Coanda effect airflow used in drying. The Overly U.S. Pat. No. 3,587,177 employs the Coanda effect for web cleaning, although without using the term "Coanda". Recently, Thermo Wisconsin, Inc., a Wisconsin company, has manufactured and sold a device called a FiberMaster web cleaner which employs the Coanda effect to control airflow for web cleaning. The FiberMaster web cleaner is constructed and operates substantially along the lines disclosed in the Pollack U.S. Pat. No. 5,466,298 and U.S. Pat. No. 5,577,294. It employs a Coanda effect nozzle and stepped airfoil to direct a turbulent stream of air in counterflow to the boundary layer of air accompanying the tissue on one side of the tissue. FiberMaster web cleaners are normally used in tissue reeling operations and utilize air pressures of 20 inches $H_2O$ or less. Yet another web cleaner employing the Coanda effect is disclosed in the Horn U.S. Pat. No. 5,490,300.

Although it seems clear that significant amounts of environmental dust and lint can be removed using air cleaners of one type or another, the incidence of customer complaints about loose dust and lint in the finished product persists. The present invention is directed toward overcoming the shortcomings of existing web cleaners and methods for removing dust and lint, and producing tissue which is lower in dust and lint content than heretobefore considered possible.

SUMMARY OF THE INVENTION

An object of the present invention is to provide an improved Coanda effect web cleaner for removing dust and lint from a web of tissue during the manufacture of facial tissues or the like.

Another object is to provide a Coanda effect web cleaner for removing dust and lint from a web of tissue wherein air, dust and lint flow into an exhaust plenum in a controlled and improved manner.

Still another object is to provide a Coanda effect web cleaner which stabilizes the web as it passes and prevents web pull-down into the exhaust area.

A further object is to provide a Coanda effect web cleaner and web cleaning system which find particularly advantageous application for removing dust and lint from a web of tissue in a rewinding machine.

Still a further object is to provide a new and improved method for removing dust and lint from a web of tissue in a rewinding machine.

Yet a further object is to provide an improved tissue product having a surprisingly low dust and lint count.

The foregoing and other objects are realized in accord with the present invention by providing an improved Coanda effect web cleaner and system, a new and improved web cleaning method, and a resultant low dust and lint count tissue product. The improved Coanda effect web cleaner comprises an elongated, curved airfoil formed adjacent a narrow slit defining a Coanda nozzle out of which a jet of air is forced. The curved airfoil is a continuous, uninterrupted surface extending from adjacent the slit to an exhaust outlet for the unit. From about 15 to 35 cfm of air per foot of slit length exits the slit, under a relatively low pressure of between 20 and 80 inches $H_2O$. The air exits the slit, which is 0.002 to 0.015 inches wide, in a thin layer and at a velocity of 18,000–34,000 fpm. The thin layer of air attaches to the airfoil surface as a result of the Coanda effect. As it does so, it scrubs away, and carries with it, the boundary layer of air which is traveling with an adjoining surface of a tissue web. This boundary layer air is laden with dust and lint. It also scrubs away dust and lint which is partially embedded, i.e., mechanically entangled, in the tissue surface. The Coanda effect air flow, with the dust and lint "scrubbed" from the web with the boundary layer, and with loose dust and lint physically pulled from the web surface, travels to the exhaust outlet along the airfoil surface and is drawn into an exhaust plenum.

A system of two of these improved web cleaners are mounted in a tissue web rewinding machine, one above and one below the web path. Each of these web cleaners includes a Coanda nozzle slit which is preferably 0.012 inches in width. According to the method of the invention, about 15 to 35 cfm of air per foot of slit under a pressure of between 20 and 80 inches $H_2O$ in an air supply plenum is forced out of each slit next to the adjacent airfoil surface. The resultant air jets create thin, stable, non-turbulent layers of air which attach to respective curved surfaces, creating low pressure zones adjacent each nozzle which tends to draw the tissue web toward that nozzle. The air jet created layers, traveling at high exit flow velocities of 18,000–34,000 fpm, carry dust and lint to exhaust plenums from both surfaces of the multiple-ply web in the rewinding machine. Meanwhile, slightly upstream of these air foil surfaces, each web cleaner has a web stabilizer airfoil which attracts and supports the moving web while preventing the web from being drawn far out of its path by the effect of the exhaust. The two web cleaners are offset from each other relative to web travel, the lower one being upstream, although they may be reversed or opposed to each other.

A multiple ply tissue is produced with an unexpectedly low dust and lint count. In practice, it has been found that a multiple ply tissue having an MD Slope of less than 8.0 Kg can be produced with a dust and lint count of less than 10,000 per eight square feet of tissue surface.

BRIEF DESCRIPTION OF THE DRAWINGS

The invention, including an improved web cleaner, a system of web cleaners, and a method of cleaning surface dust and lint from a tissue web, is illustrated more or less diagrammatically in the following drawings, in which.

DESCRIPTION OF THE PREFERRED EMBODIMENT

Figure 1:
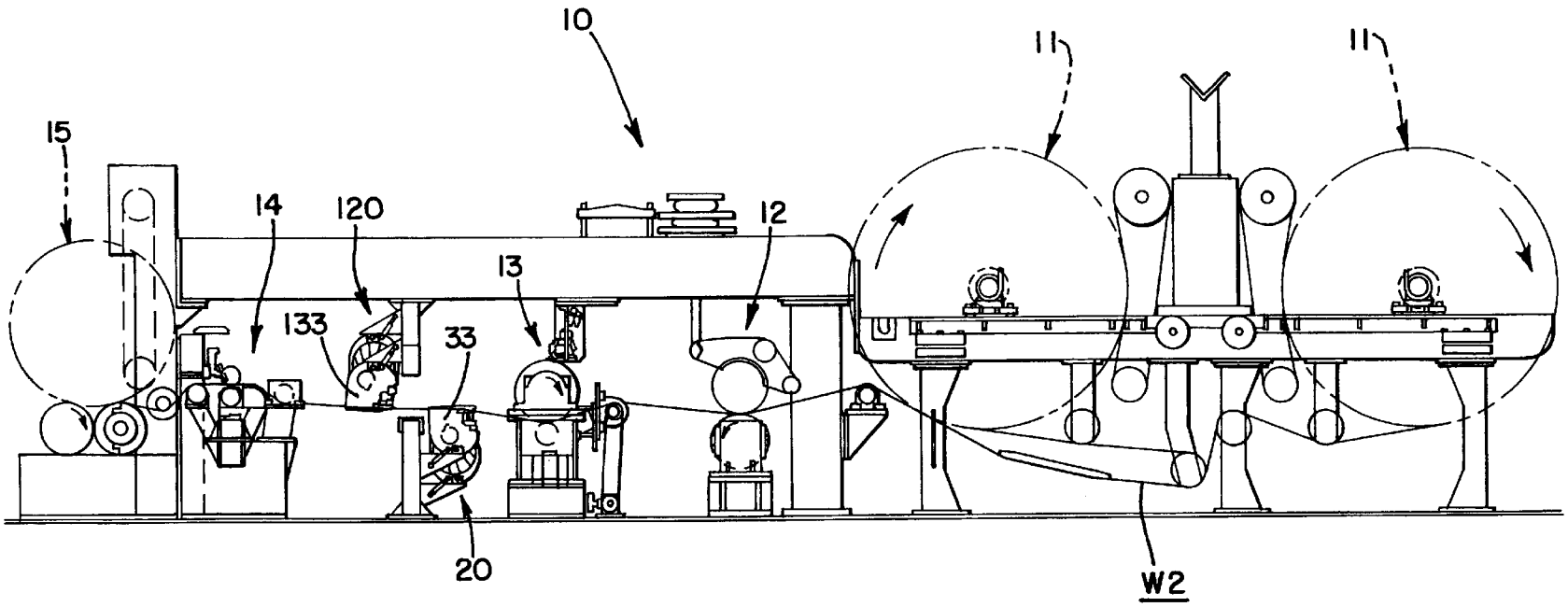
FIG. 1 is a schematic illustration of a tissue rewinding machine incorporating improved Coanda effect web cleaners in a system embodying features of the present invention.

Referring now to the drawings, and particularly to FIG. 1, a tissue web rewinding machine is schematically illustrated at 10. The rewinding machine 10 utilizes two soft roll reels 11 of tissue web positioned adjacent to each other. A web is drawn from each of the two reels 11, so that two webs are traveling in face-to-face relationship, creating a two-ply web W2. The dryer side of each single ply web faces outwardly in the web W2. The web W2 passes through a calendar 12 and then a crimping station 13. The latter creates crimp bonds between the two plies.

After leaving the crimping station 13, the crimped web W2 travels to a slitting station 14 which creates multiple, 8½-inch wide webs of two-ply tissue. These 8½ inch wide webs are wound into hard rolls on a common core in a rewinder 15. Subsequently, conventional converting operations are employed to cut, fold and package individual, multiple-ply tissues from the 8½-inch wide webs.

Between the crimping station 13 and the slitting station 14, a system of improved Coanda effect web cleaners 20 and 120 embodying features of the invention are utilized, according to the invention, to remove loose dust and lint from the dry side surfaces of the web W2 and from the boundary layers of dust and lint laden air accompanying them. As will hereinafter be discussed in detail, the construction and arrangement of the system of web cleaners 20 and 120, and the method of cleaning the tissue web W2, are effective to remove substantial quantities of dust and lint from the web surfaces and, consequently, to improve the quality of facial tissue products. Accepted knowledge has been that downstream converting operations tend to create dust and lint, negating any benefits of cleaning the web in the rewinding operation. Specifically, it was thought that the tissue being dragged across web handling components downstream would create more dust and lint than could be removed upstream. The system and method of the present invention have been able to effect such substantial cleaning in the rewinder that an overall reduction remains after downstream converting operations.

Figure 2:
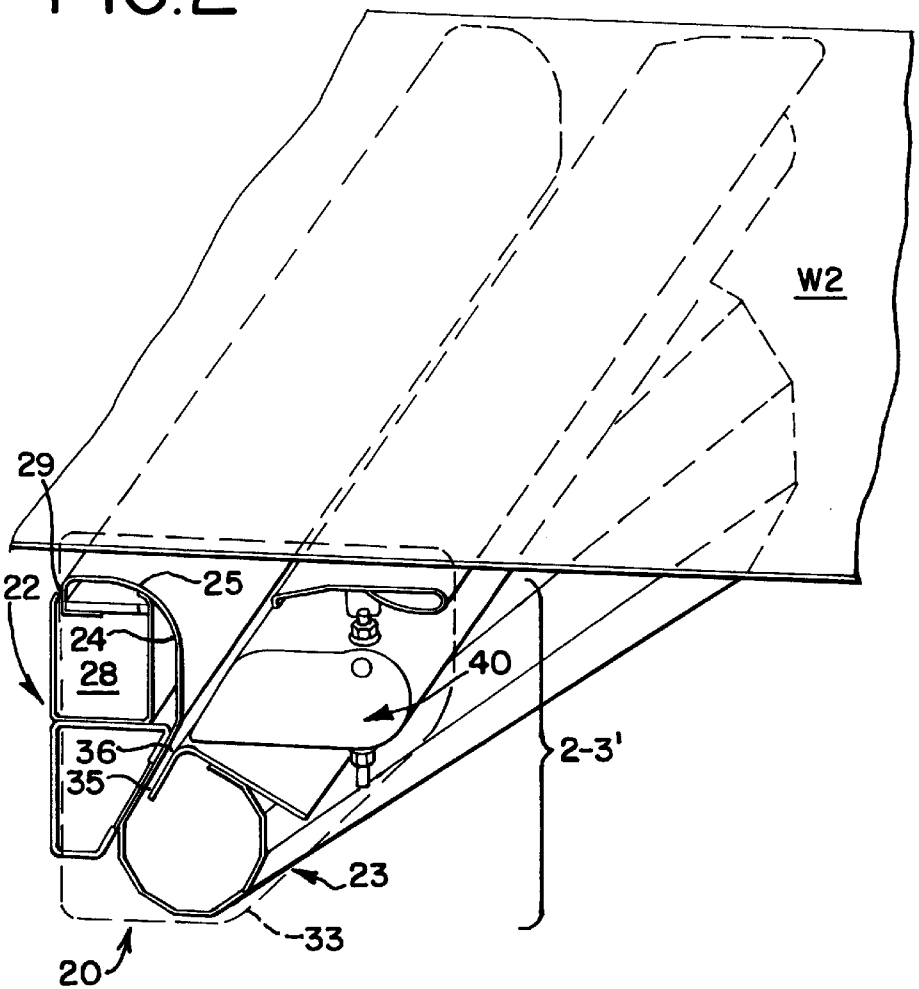
FIG. 2 is a perspective view of an improved Coanda effect web cleaner embodying features of the invention, in operational position adjacent a tissue web in a rewinding machine, with an end plate shown in phantom lines.

Referring now to FIG. 2, a web cleaner 20 embodying features of the present invention is shown in greater detail. The web cleaner 20 is shown in operational relationship with a two-ply tissue web W2 immediately upstream of the slitting station 14 and the rewinder 15.

Figure 3:
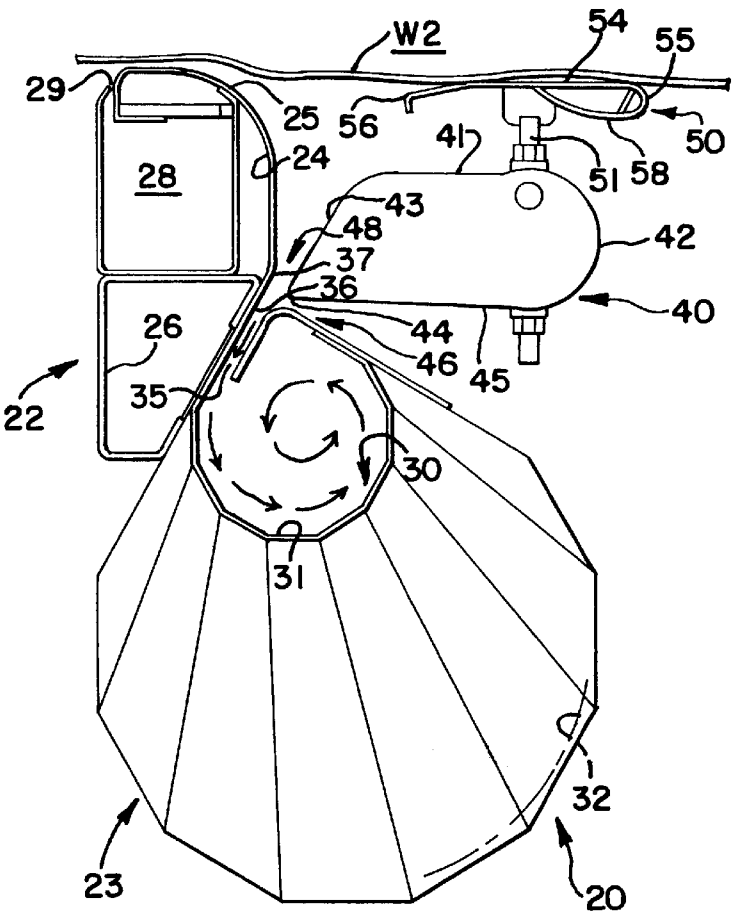
FIG. 3 is a side elevational view of the web cleaner and tissue web seen in FIG. 2, with an end plate removed.

Referring also to FIG. 3, the web cleaner 20 underlies the web W2. As it moves, the web W2 carries a boundary layer of air along with it, on both its upper and lower surfaces. These boundary layers of air, which might be several inches thick in a rewinding machine, entrain loose environmental dust and lint. If this dust and lint is not removed, it adheres to the web W2 as the web is further processed. The web W2 also has loose dust and lint on its surfaces and partially embedded or entangled in its surfaces. If this dust and lint is not removed, it also ends up on the finished tissue product.

The web cleaner 20 includes an air supply plenum and airfoil housing 22. The housing 22 extends across the width of the web W2 and is mounted on one side of a correspondingly elongated exhaust housing 23.

The housing 22 has arcuate wall 24 with an outer surface 25 which forms an airfoil. Below the wall 24, inside the housing 22, a scrubber air supply plenum 28 is mounted. A generally C-shaped channel member 26 supports the plenum 28. The air supply plenum 28 receives air under pressure from a suitable supply (not shown).

A Coanda nozzle 29 is formed along the length of the plenum 28, adjacent to and overlooking the airfoil surface 25. The nozzle 29 is defined by a slit in the plenum 28, immediately adjacent the wall 24. The slit 29 is 0.012 (±0.0002) inches in width along its entire length. In the web cleaner 20 illustrated, the slit would be approximately 190 inches long.

In operation of the web cleaner 20, as hereinafter discussed, air under a pressure of 20 to 80 inches $H_2O$ in the plenum 28 is forced out of the slit 29 at about 15–35 cfm (per foot length of slit) to create a jet of air directed toward the web W2 in a thin layer. The thin layer of air, traveling at between 18,000 and 34,000 fpm, attaches to and flows over the airfoil surface 25, following it in a direction opposite to the direction of travel of the web W2.

The exhaust housing 23 is octagonal in cross-section. The housing 23 is also tapered and contains a correspondingly frusto-conically shaped exhaust plenum 30. A small diameter end 31 of the plenum 30 is closed by an end plate 33 (seen in dotted lines in FIG. 3). A large diameter outlet port 32 is formed in the large diameter end.

An exhaust slot 35 extends along the length of the plenum 30. The exhaust slot 35 is oriented so that it forms a passage extending tangentially into the plenum 30. The inlet opening 36 to the slot 35 is positioned immediately adjacent the terminal end 37 of the airfoil surface 25. In this relationship, the slot 35 is also oriented so as to extend in substantial alignment with the airfoil surface 25 in the area adjacent the terminal end 37 where this surface approaches the opening 36, i.e., it is disposed at an angle of less than 30° to the surface 25 in this area.

Upstream (relative to web W2 travel) of the airfoil surface 25 and the exhaust slot 35 is an exhaust damper housing 40. The damper housing 40 is in the form of an airfoil and has an upper surface which extends rearwardly, at 41, from a leading edge surface 42 and downwardly, at 43, to a trailing edge 44. A lower surface 45 also extends rearwardly from the surface 42 to the trailing edge 44. The damper housing 40 extends across the width of the web W2, like the housings 22 and 23. The housing 40 is supported in the unit 20 in a manner which permits adjustment of the positions of surfaces 43 and 45, for reasons hereinafter discussed.

The damper housing 40 functions as both a flow control airfoil for boundary layer airflow and as an exhaust damper. In the latter regard, it will be seen that the flat surface 45 forms a restricted passage 46 with the outer surface 47 of the exhaust housing 23. At the same time, the surface 43 forms a restricted passage 48 with the airfoil surface 25 adjacent its terminal end 37.

The damper housing 40 has a web stabilizer 50 mounted on pylons 51 on its upper surface 41. The stabilizer 50 also has an airfoil-shape in cross-section. It has an upper airfoil surface 54 which extends between a leading edge 55 and a trailing edge 56. A lower, curved surface 58 also defines an airfoil. The web stabilizer 50 extends along the housing 40 over the entire width of the web W2. According to the invention, for reasons hereinafter discussed, the top of the airfoil surface is positioned about one-half inch (½") lower than the airfoil surface 25 above the nozzle 29.

In operation of the web cleaner 20 in the rewinding machine, the web W2 is traveling at 2000–4000 fpm with a boundary layer of air and entrained environmental dust and lint on its upper and lower surfaces. The underlying boundary layer traveling with the web W2 strikes the lead-in stabilizer airfoil 50 and a large portion of the boundary layer is torn away, i.e., separates from the web, and flows under the airfoil surface 58. The web W2 is supported and stabilized across its width by the upper surface 54 of the stabilizer 50, on the remaining boundary layer air with its entrained dust and lint.

The tissue web W2 travels on toward the airfoil surface 25. Air at a pressure of 20–80 inches $H_2O$ is supplied to the plenum 28 and about 15 to 35 cfm of air per foot of slit 29 is forced out of the elongated Coanda nozzle slit 29 in a jet forming a thin layer of fast moving air. The thin air layer, which extends the length of the nozzle slit 29 and is traveling at 18,000–34,000 fpm away from the slit, attaches to the continuously curved airfoil surface 25. Because of its high velocity there, the moving layer of air creates a low pressure area adjacent the nozzle slit 29. This low pressure area causes the web W2 to be drawn close to, but not into contact with, the nozzle slit 29. The web W2 is stabilized across its width by this effect.

According to the invention, the web W2 is stabilized by the web stabilizer 50 in a plane slightly lower than the plane at which it is stabilized over the slit 29, as seen in FIG. 3. This is because the surface 54 is slightly lower than the surface 25 above the nozzle 29, and permits the web W2 to be drawn downwardly with the Coanda air flow over surface 25 to a greater degree without over-stressing the web. More efficient cleaning results without more web W2 breaks.

The thin jet layer of high velocity air, traveling in a direction opposite to web W2 movement, scrubs away the remaining boundary layer air and entrained dust and lint from the web on that side of the web. It also shears away loose, but embedded or entangled, dust and lint from the web W2 surface. This "scrubber" air, loaded with dust and lint, follows the curved airfoil surface 25 toward the inlet opening 36 of the exhaust slot 35, leading into the exhaust plenum 30.

Meanwhile, a partial vacuum is created in the exhaust plenum 30 by a suitable source of reduced pressure (not shown). Sufficient suction is created to draw a high volume of air into the plenum 30 through the slot 35; a volume which is approximately ten times the volume of scrubber air supplied to the system from the Coanda nozzle slit 29. The scrubber air, with its dust and lint load, is sucked into the plenum 30. Because more air is being sucked into the plenum 30 than is supplied as scrubber air, environmental dust and lint from the area and from the detached boundary layer air traveling along the damper housing surface 41, 43 is also drawn into the plenum.

The exhaust damper 40 channels dust and lint loaded air on its airfoil surface 41, 43 through the restricted passage 48 toward the slot 35. At the same time, air from below the damper 40 is drawn upwardly through the restricted passage 46, toward the inlet opening 36 of the exhaust slot 35. Thus, the damper 40 channels air drawn from both above and below the damper, toward the exhaust slot 35.

By adjusting the position of the exhaust damper 40, the width of each of the passages 46 and 48 can be controlled. Thus, the amount of suction pulling the web W2 toward the exhaust slot 35 can also be controlled. A balance with the air which flows upwardly through the passage 46 to the slot 35 from below is achieved. As a result, the web W2 is not sucked downwardly toward the exhaust slot 35, but the dust and lint laden air beneath it is removed.

The exhaust housing 23 is constructed so that the exhaust slot 35 is tangentially oriented relative to the housing. This causes a swirling action to occur inside the plenum 30 as the lint and dust laden air is sucked in and through the plenum 30, creating a self-cleaning action inside the plenum.

The diameter of the plenum 30 increases from the closed end 31 to its outlet end 32, as has been pointed out. As a result, the exhaust suction in the exhaust slot 35 is uniform along the length of the plenum 30.

Turning to FIG. 1, a pair of web cleaners 20 and 120 are shown in operational position below and above the two-ply web W2 between the crimping station 13 and the slitting station 14 in the rewinding machine. Respective end plates 33 and 133 are seen. Here, the two plies of tissue are unwound from reels so that their dryer (softer) sides are facing outwardly. Thus, it will be seen that the two-ply web W2 created in the rewinding machine has its dryer or softer sides facing outwardly.

The web cleaner 120 is mounted above the web W2 in a relationship corresponding to that of the cleaner 20 to the web W2, albeit inverted. The cleaner 120 is constructed and operates in a manner identical to that of the cleaner 20. Accordingly, corresponding reference numerals plus 100 digits are used to indicate corresponding components and no further description is considered necessary.

According to the invention in its preferred form, however, the web cleaner 20 is positioned upstream from the unit 120. As will be seen, it is offset upstream by approximately the length (along the web W2) of the cleaner 20. This arrangement of cleaners 20 and 120 produces optimum dust and lint removal.

In operation of the system comprising the web cleaners 20 and 120 in a tissue web rewinding machine, air under a pressure is directed out of each Coanda nozzle slit 29 and 129 next to the adjacent airfoil surfaces 25 and 125. The thin layer of air created by the resultant jet attaches to the curved surfaces, creating low pressure zones adjacent to each nozzle, which tends to draw the tissue toward those nozzles. The air, traveling at high exit flow velocities of 18,000–34,000 fpm, shears away dust and lint from both surfaces of the multiple-ply web in the rewinding machine.

In utilizing the system and practicing the method of the invention, tests were conducted with the improved Coanda effect web cleaners 20 and 120 in the rewinding machine. Two different two ply tissue web compositions were employed, a relatively low dust composition identified as $T_2$ tissue and a higher dust composition identified as $T_1$ tissue. The $T_2$ tissue was a lightly creped, service and industrial quality tissue. The $T_1$ tissue was a highly creped, soft, premium-type tissue.

Softness of a tissue is normally a function of the stiffness of the dried tissue (low stiffness equates with high softness) and the bulk of the tissue (high bulk equates with high softness). Stiffness can be objectively represented by the slope of the machine direction (MD) load/elongation curve for the tissue, hereinafter referred to as the MD slope. Thus, the MD slope for a tissue is an effective indicator of softness.

A load versus elongation curve for a tissue is defined here in terms of elongation in a strip of tissue three inches wide, per unit of load. The slope of the curve is the MD tensile slope, expressed in Kg. It has been found that desirably soft tissues have an MD slope of 8.0 Kg or less over a range of 70 to 157 grams of load. The tissue webs $T_1$ and $T_2$ were rewound separately, using the web cleaner system of the invention over a range of scrubber air plenum pressures. Each of the webs $T_1$ and $T_2$ was then examined to count remaining loose surface dust and lint particles.

The examination was conducted using the procedure described in Walters U.S. Pat. No. 4,950,545, at Column 5, line 45 through Column 6, line 9, which is incorporated herein by reference. The following dilution procedure was utilized:

1. Pour the sample jar into a 500 ml graduated cylinder. Rinse the sample jar with distilled water into the graduated cylinder bringing the total volume up to 400 ml.
2. Uniformly mix the sample from step 1 and divide into identical 200 ml samples A and B.
3. Take sample A, pour and rinse container with distilled water into a 2000 ml graduated cylinder. Bring the total volume up to 1,500 ml with distilled water. Uniformly mix the sample, then decant three identical 250 ml samples into three separate Kajaani measuring beakers. Note ½ of this sample is not analyzed.
4. Measure the total fiber count in each sample with a Kajaani FS 200 fiber analyzer. Record the result for each sample.
5. Repeat steps 3 and 4 for sample B.
6. Average the six fiber counts for all the samples and record as the final number.

The aforedescribed dilution procedure has been found useful for measuring a dust concentration of the water collected in the sample tray. It works well for dust levels normally associated with premium facial tissues. It has been designed to dilute the water in the sample tray to a fiber concentration which can be counted on the Kajaani 200 FS fiber analyzer without the need for use of the machine's auto dilution procedure. It measures a relative dust concentration and does not count all of the particles contained in the sample tray. A higher average particle count indicates more loose surface dust and correlates with increased consumer complaints.

If the samples from step 4 either fail to count accurately from too low of a concentration or the Kajaani FS 200's auto dilution sequence operates the results are invalid. The dilution procedure needs to be modified by those skilled in the art and results cannot be compared directly to samples tested using the above procedure. Other analysis techniques can be employed to measure and record the dust concentration for the sample in the water tray.

Figure 4:
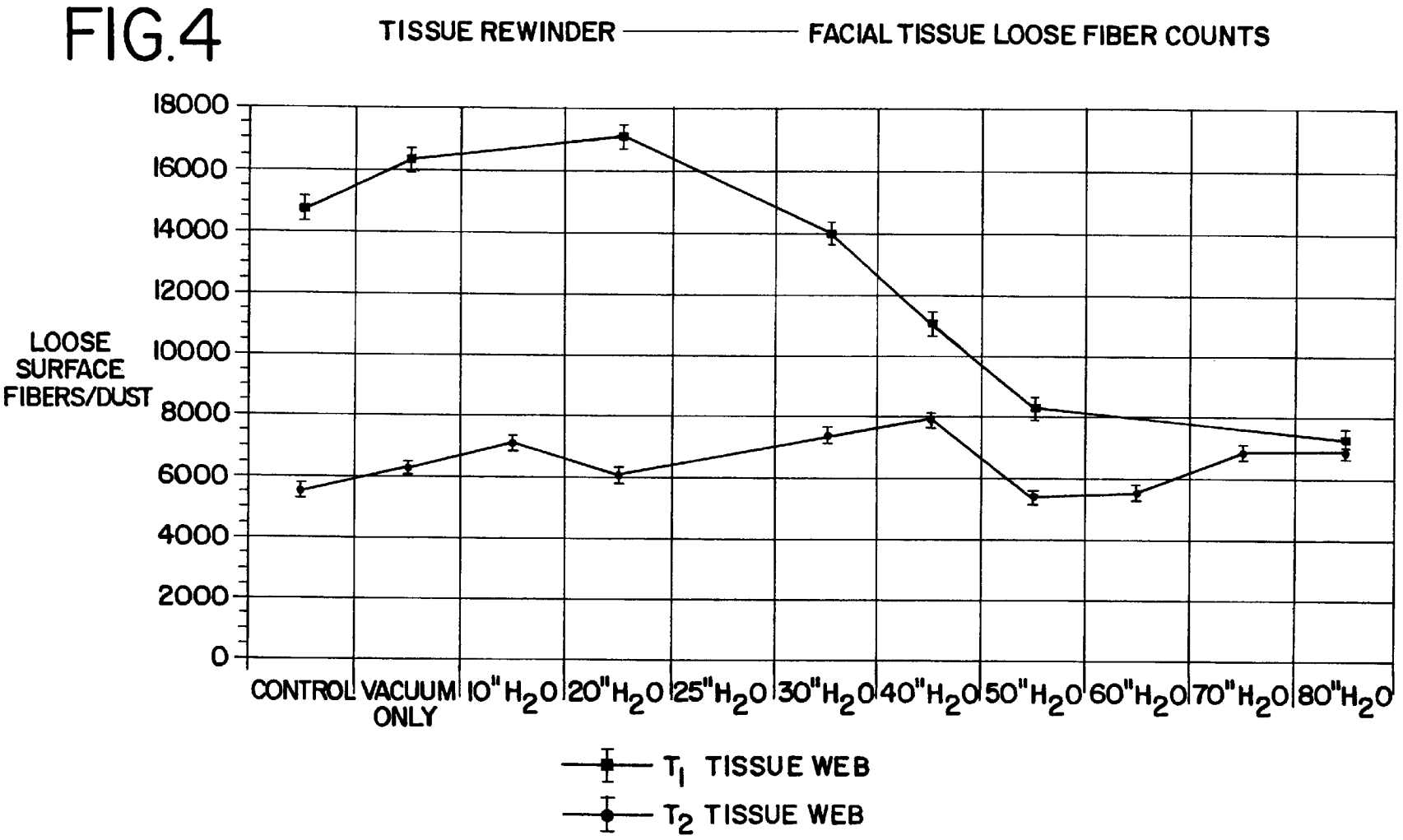
FIG. 4 is a graph illustrating loose fiber counts in converted facial tissue which has been treated by the web cleaning method embodying features of the present invention.

FIG. 4 is a graph which represents the dust and lint found on the web as a result of the afore described examination. For the graph, the count was taken from each of the six fractions reported. These were averaged, yielding the number in the graph. The lines represent values correlated to the loose surface dust and lint present on webs per eight square feet of tissue surface after passing through the rewinding machine and in the hardroll. A higher number would indicate more loose surface dust and lint. The abscissa (X-coordinate) of the graph represents an untreated control web, a vacuum only treated web (no Coanda nozzle air), and a series of webs treated with increasing Coanda nozzle air pressures (10 inches $H_2O$ through 80 inches $H_2O$). The ordinate (Y-coordinate) of the graph represents loose surface dust and lint counts in total particles.

It will be seen in FIG. 4 that with the normally dustier $T_1$ tissue web, a 50% reduction in surface particles is achieved from each web surface with a Coanda effect system in the rewinder when scrubber air pressure is at 50 inches $H_2O$ or higher. A count of less than 10,000 loose surface fiber/dust particles remained in the diluted sample, per eight square feet of tissue surface. Relatively little particle removal is achieved with the less soft, low dust tissue $T_2$. The importance is that with the highly desirable, softer premium tissue, surface dust can be reduced to the level normally associated only with lower quality, service and industrial type tissues by employing the Coanda nozzle effect system in the rewinding machine according to the method of the invention.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. A method of manufacturing a multiple-ply tissue having an unexpectedly low loose dust and lint count by removing dust and lint from both outwardly facing surfaces of a multiple-ply tissue web while the web is traveling with its accompanying boundary layers of air in a predetermined plane and direction in a tissue rewinding machine, comprising the steps of:

a) directing scrubber gas in a transversely elongated jet from a slit defining a Coanda nozzle so that the jet forms a thin, non-turbulent layer of rapidly moving gas which moves in a direction opposite to web travel and scrubs the boundary layer of air and entrained dust and lint, as well as dust and lint embedded in one surface of the web, away from the one surface of said web;

b) directing said scrubber gas with the air and lint and dust which it has removed from said one surface of said web to follow a Coanda nozzle airfoil surface adjacent said slit until it reaches and is drawn into an exhaust plenum;

c) simultaneously directing another transversely elongated jet of scrubber gas from another slit defining a second Coanda nozzle so that it forms a thin, non-turbulent layer of rapidly moving gas which moves in a direction opposite to web travel and scrubs the boundary layer of air and entrained dust and lint as well as dust and lint embedded in the other surface of said web, away from the other surface of said web; and d) directing said scrubber gas with the air and lint and dust which it has removed from said other surface of said web to follow a second Coanda nozzle airfoil surface adjacent said another slit until it reaches and is drawn into an exhaust plenum.

2. The method of claim 1 further characterized by and including the step of:

a) creating the jets of scrubber gas by maintaining a gas pressure from 20 inches $H_2O$ to 80 inches $H_2O$ in a plenum from which the gas departs through each slit.

3. A method of manufacturing a multiple-ply tissue having an unexpectedly low loose dust and lint count by removing dust and lint from both outwardly facing surfaces of a multiple-ply tissue web while the web is traveling with its accompanying boundary layers of air in a predetermined plane and direction in a tissue rewinding machine, comprising the steps of:

a) under a pressure of at least 20 inches $H_2O$, directing scrubber gas in a transversely elongated jet from a slit defining a Coanda nozzle having a width of between 0.002 and 0.015 inches so that the jet forms a thin, non-turbulent layer of rapidly moving gas which moves in a direction opposite to web travel and scrubs the boundary layer of air and entrained dust and lint, as well as dust and lint embedded in the surface of the web, away from one surface of said web;

b) directing said scrubber gas with the air and lint and dust which it has removed from said one surface of said web to follow a Coanda nozzle airfoil surface adjacent said slit until it reaches and is drawn into an exhaust plenum;

c) simultaneously directing another transversely elongated jet of scrubber gas from another slit defining a second Coanda nozzle having a width of between 0.002 and 0.015 inches so that it forms a thin, non-turbulent layer of rapidly moving gas which moves in a direction opposite to web travel and scrubs the boundary layer of air and entrained dust and lint, as well as dust and lint embedded in the surface of said web, away from the other surface of said web; and d) directing said scrubber gas with the air and lint and dust which it has removed from said other surface of said web to follow a second Coanda nozzle airfoil surface adjacent said another slit until it reaches and is drawn into an exhaust plenum.

4. The method of claim 3 further characterized by and including the step of:

a) creating the jets of scrubber gas by maintaining a gas pressure from 20 inches $H_2O$ to 80 inches $H_2O$ in a plenum from which the gas departs through each slit.

5. The method of claim 4 further characterized in that:

a) said gas pressure is at least 50 inches $H_2O$.

6. The method of claim 5 further characterized in that:

a) each of said Coanda nozzle slits has a width of about 0.012 inches.

7. The method of claims 1 or 3 including the additional step of:

a) stabilizing the web before it reaches each of said Coanda nozzle airfoil surfaces by passing it over two additional airfoil surfaces each of which corresponds to one of the two Coanda nozzle airfoil surfaces.

8. The method of claim 7 wherein:

a) each of said additional two airfoil surfaces is disposed in a plane further from the web than its corresponding Coanda nozzle airfoil surface.

9. The method of claims 1 or 3 including the additional step of:

a) drawing more air into each exhaust plenums than is supplied by the corresponding Coanda nozzle.

10. The method of claim 9 further including the step of:

a) controlling the amount of air drawn into each exhaust plenum by adjusting the position of an exhaust damper over which air is drawn into each exhaust plenum.

11. The method of claims 1 or 3 wherein:

a) each exhaust plenum is approximately frusto-conical in shape so as to be tapered from one end to an opposite end; and b) each exhaust plenum has a tangentially disposed opening so that air being drawn into it is swirled within the plenum.

* * * * *